United States Patent [19]

Nolan

[11] Patent Number: 4,723,093

[45] Date of Patent: Feb. 2, 1988

[54] GAS DISCHARGE DEVICE

[75] Inventor: James F. Nolan, Sylvania, Ohio

[73] Assignee: Owens-Illinois Television Products Inc., Toledo, Ohio

[21] Appl. No.: 579,751

[22] Filed: May 21, 1975

Related U.S. Application Data

[63] Continuation of Ser. No. 396,337, Sep. 11, 1973, abandoned, which is a continuation-in-part of Ser. No. 764,577, Dec. 2, 1968, abandoned, and Ser. No. 851,416, Aug. 19, 1969, abandoned, and Ser. No. 851,713, Aug. 19, 1969, abandoned.

[51] Int. Cl.[4] ..... H01J 61/16

[52] U.S. Cl. ..... 313/643

[58] Field of Search ..... 313/201, 226, 643

[56] References Cited

U.S. PATENT DOCUMENTS 3,814,971 6/1974 Bhattacharya ..... 313/226

*Primary Examiner*—William D. Larkins

*Attorney, Agent, or Firm*—H. G. Bruss

[57] ABSTRACT

There is disclosed a gas discharge panel, especially of the type described in U.S. Pat. No. 3,499,167 or 3,559,190, operated with an ionizable gaseous medium of neon and at least one minority rare gas component selected from argon, krypton, and xenon. In one embodiment, there is used a gaseous medium of about 99.5 to 99.99 percent atoms of neon and 0.5 to 0.01 percent atoms or at least one minority gas component.

5 Claims, 10 Drawing Figures

MINIMUM SUSTAINING VOLTAGE AT PASCHEN MINIMUM
Vs
MINORITY GAS CONCENTRATION
Pure Ne
Ar
Xe
N2
Kr
MINORITY GAS CONCENTRATION (%)
0.01
0.1
1.0
10.0
90
100
110
120
130
140
150
160
VE (VOLTS)

PEAK DISCHARGE CURRENT (Id)
VS
MINORITY GAS CONCENTRATION
N2
Xe
Kr
Ar
Id (mA)
MINORITY GAS CONCENTRATION (%)
70
60
50
40
30
20
10
0
0.01
0.1
1.0
10.0

EFFICIENCY (LUMENS/WATT)
VS.
MINORITY GAS CONCENTRATION
Ar
Kr
Xe
N2
MINORITY GAS CONCENTRATION (%)
0.01
0.1
1.0
10.0
E x 10^3 (LUMENS/WATT)
56
52
48
44
40
36
32
28
24
20
16
12
8
4
0

FIGURE OF MERIT (LUMENS/WATT-2)×10^4

GAS DISCHARGE DEVICE

RELATED APPLICATIONS

This application is a continuation of copending U.S. patent application Ser. No. 396,337, filed Sept. 11, 1973, now abandoned which is a continuation-in-part of previously copending U.S. patent application Ser. No. 764,577, filed Oct. 2, 1968, now abandoned; previously copending U.S. patent application Ser. No. 851,416, filed Aug. 19, 1969, now abandoned; and previously copending U.S. patent application Ser. No. 851,713, filed Aug. 19, 1969, now abandoned.

BACKGROUND OF THE INVENTION

This invention relates to gas discharge devices, especially multiple gas discharge display/memory devices which have an electrical memory and which are capable of producing a visual display or representation of data such as numerals, letters, radar displays, aircraft displays, binary words, educational displays, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area on alternate half cycles to constitute an electrical memory.

An example of a panel structure containing non-physically isolated or open discharge cells is disclosed in U.S. Pat. No. 3,499,167 issued to Theodore C. Baker, et al.

An example of a panel containing physically isolated cells is disclosed in the article by D. L. Bitzer and H. G. Slottow entitled "The Plasma Display Panel—A Digitally Addressable Display With Inherent Memory", Proceeding of the Fall Joint Computer Conference, IEEE, San Francisco, Calif., November 1966, pages 541–547. Also reference is made to U.S. Pat. No. 3,559,190.

In the construction of the panel, a continuous volume of ionizable gas is confined between a pair of dielectric surfaces backed by conductor arrays typically forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental or discrete areas will be twice the number of such elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing electrodes, but between two contiguous or adjacent electrodes on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly, i.e., a segmented display.

The gas is one which produces visible light or invisible radiation which stimulates a phosphor (if visual display is an objective) and a copious supply of charges (ions and electrons) during discharge.

In an open cell Baker, et al. type panel, the gas pressure and the electric field are sufficient to laterally confine charges generated on discharge within elemental or discrete dielectric areas within the perimeter of such areas, especially in a panel containing non-isolated discharge cells. As described in the Baker, et al. patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition at least one elemental volume other than the elemental volume in which the photons originated.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharge", such prior art devices utilized frequencies and spacing or discharge volumes and operating pressures such that although discharges are initiated in the gaseous medium, such discharges are ineffective or not utilized for charge generation and storage at higher frequencies; although charge storage may be realized at lower frequencies, such charge storage has not been utilized in a display/memory device in the manner of the Bitzer-Slottow or Baker, et al. invention.

The term "memory margin" is defined herein as $$M.M. = \frac{V_f - V_E}{V_f/2}$$

where $V_f$ is the half amplitude of the smallest sustaining voltage signal which results in a discharge every half cycle, but at which the cell is not bi-stable and $V_E$ is the half amplitude of the minimum applied voltage sufficient to sustain discharges once initiated.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

As used herein, a cell is in the "on state" when a quantity of charge is stored in the cell such that on each half cycle of the sustaining voltage, a gaseous discharge is produced.

In addition to the sustaining voltage, other voltages may be utilized to operate the panel, such as firing, addressing, and writing voltages.

A "firing voltage" is any voltage, regardless of source, required to discharge a cell. Such voltage may be completely external in origin or may be comprised of internal cell wall voltage in combination with externally originated voltages.

An "addressing voltage" is a voltage produced on the panel X - Y electrode coordinates such that at the selected cell or cells, the total voltage applied across the cell is equal to or greater than the firing voltage whereby the cell is discharged.

A "writing voltage" is an addressing voltage of sufficient magnitude to make it probable that on subsequent sustaining voltage half cycles, the cell will be in the "on state".

In the operation of a multiple gaseous discharge device, of the type described hereinbefore, it is necessary to condition the discrete elemental gas volume of each discharge cell by supplying at least one free electron thereto such that a gaseous discharge can be initiated when the cell is addressed with an appropriate voltage signal.

The prior art has disclosed and practiced various means for conditioning gaseous discharge cells.

One such means of panel conditioning comprises a so-called electronic process whereby an electronic conditioning signal or pulse is periodically applied to all of the panel discharge cells, as disclosed for example in British patent specification No. 1,161,832, page 8, lines 56 to 76. Reference is also made to U.S. Pat. No. 3,559,190 and "The Device Characteristics of the Plasma Display Element" by Johnson, et al., IEEE Transactions On Electron Devices, September, 1971. However, electronic conditioning is self-conditioning and is only effective after a discharge cell has been previously conditioned; that is, electronic conditioning involves periodically discharging a cell and is therefore a way of maintaining the presence of free electrons. Accordingly, one cannot wait too long between the periodically applied conditioning pulses since there must be at least one free electron present in order to discharge and condition a cell.

Another conditioning method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material.

Another means of internal conditioning, which we call photon conditioning, comprises using one or more so-called pilot discharge cells in the on-state for the generation of photons. This is particularly effective in a so-called open cell construction (as described in the Baker, et al. patent) wherein the space between the dielectric surfaces occupied by the gas is such as to permit photons generated on discharge in a selected discrete or elemental volume of gas (discharge cell) to pass freely through the panel gas space so as to condition other and more remote elemental volumes of other discharge units. In addition to or in lieu of the pilot cells, one may use other sources of photons internal to the panel.

Internal photon conditioning may be unreliable when a given discharge unit to be addressed is remote in distance relative to the conditioning source, e.g., the pilot cell. Accordingly, a multiplicity of pilot cells may be required for the conditioning of a panel having a large geometric area. In one highly convenient arrangement, the panel matrix border (perimeter) is comprised of a plurality of such pilot cells.

THE INVENTION

In accordance with the practice of this invention, it has been surprisingly discovered that the dynamic operational performance and characteristics of a multiple gaseous display/memory device can be significantly enhanced by utilizing a gaseous medium of about 99.5 to 99.99 percent atoms of neon and about 0.5 to 0.01 percent atoms of at least one rare gas minority component selected from argon, krypton, and xenon.

In a preferred embodiment hereof, particularly outstanding results are achieved by operating the gaseous discharge display/memory device with a gaseous medium of about 99.8 to 99.95 percent atoms of neon and about 0.2 to 0.05 percent atoms of at least one minority rare gas component selected from argon, krypton, and xenon.

In a highly preferred embodiment hereof, the minority gas component is argon.

In a further highly preferred embodiment hereof, the concentration of the minority gas component is 0.1 percent atoms.

Before the surprising discovery of this important invention, the prior art selected and used a variety of other gases in gas discharge display/memory devices of the Baker, et al. type, the most representative selections being various neon-nitrogen mixtures. Such prior art neon-nitrogen mixtures have contained at least 3 percent molecules of nitrogen, often as high as 10 percent. See U.S. Pat. No. 3,559,190 issued to Bitzer, et al.

When used in a multiple gaseous discharge display/-memory device, the gaseous medium of this invention offers important advantages over the gas mixtures used by the prior art, e.g., such as the neon-nitrogen mixtures.

More particularly, as fully demonstrated hereinafter, it has been discovered that the utilization of the specified rare gas mixture of this invention to operate a gaseous discharge display/memory device results in increased memory margin, increased luminous efficiency, decreased operating voltages, and decreased operating currents.

DRAWINGS ILLUSTRATING GAS DISCHARGE DISPLAY/MEMORY PANEL

Reference is made to the accompanying drawings and the hereinafter discussed FIGS. 1 to 4 shown thereon illustrating a gas discharge display/memory panel of the Baker, et al. type.

Figure 1:
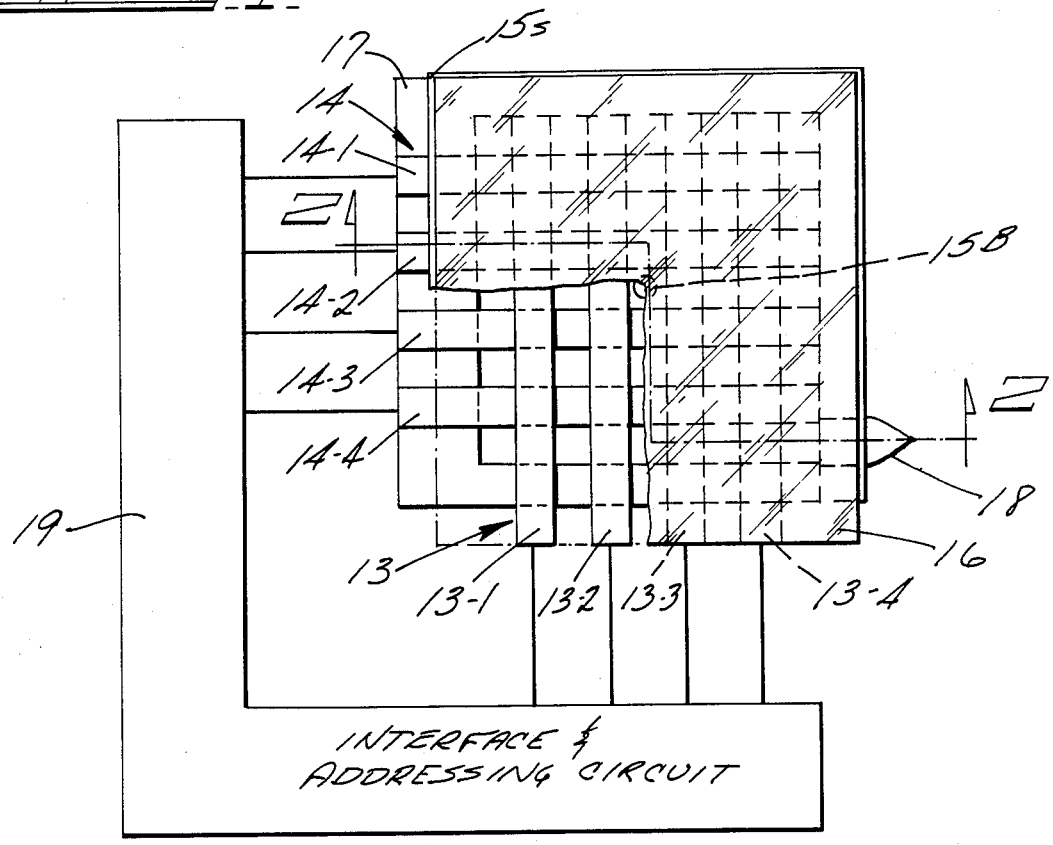

FIG. 1 is a partially cut-away plan view of a gaseous discharge display/memory panel as connected to a diagrammatically illustrated source of operating potentials.

Figure 2:
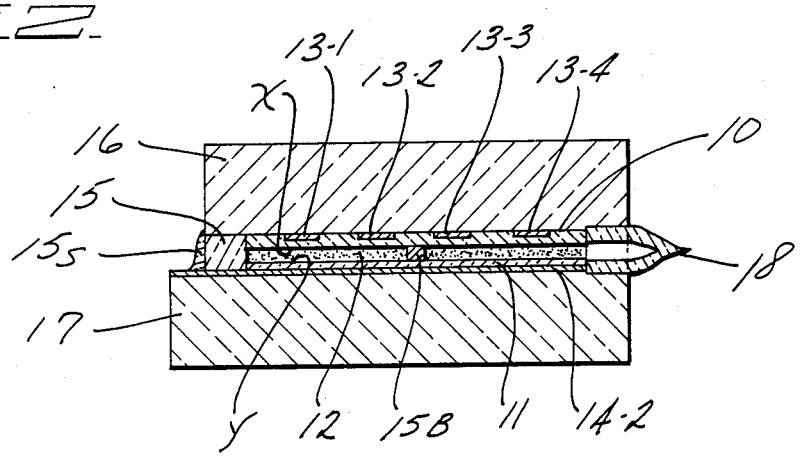
FIGS. 1–4 illustrate panel structure.

FIG. 2 is a cross-sectional view (enlarged, but not to proportional scale since the thickness of the gas volume, dielectric members and conductor arrays have been enlarged for purposes of illustration) taken on lines 2—2 of FIG. 1.

Figure 3:
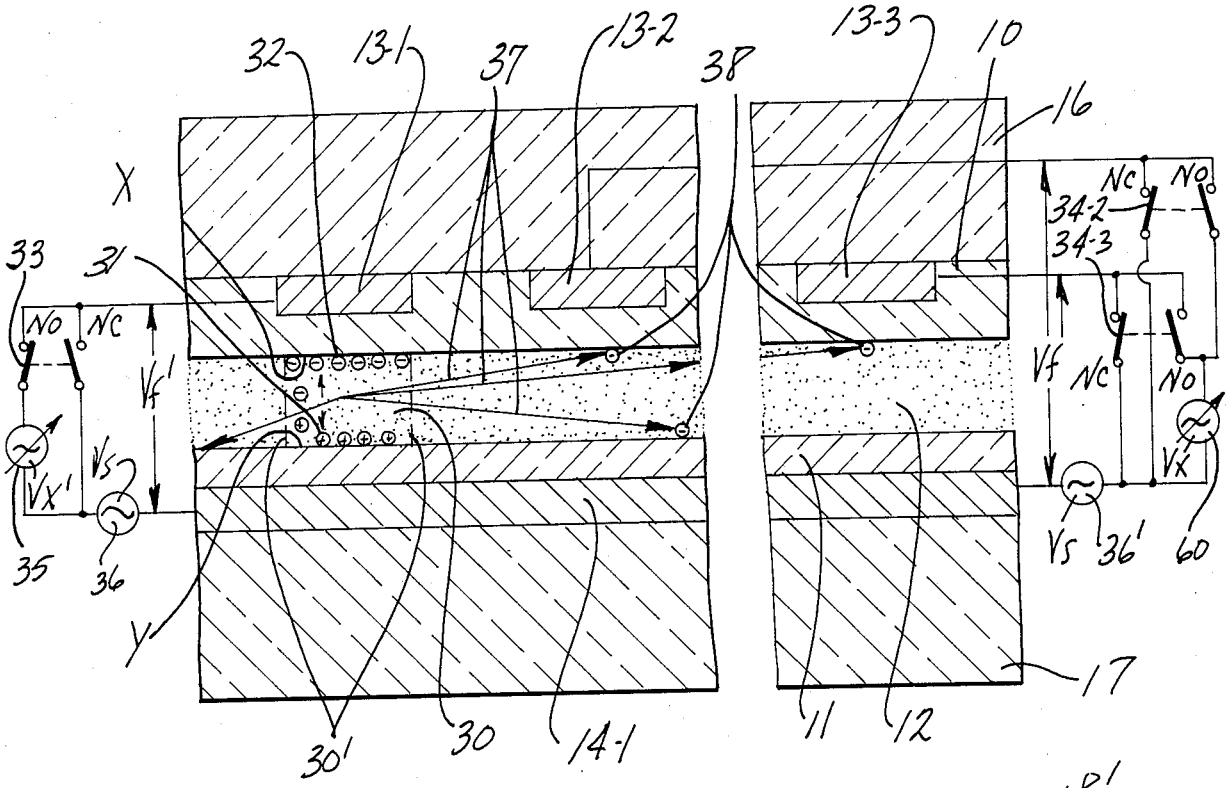

FIG. 3 is an explanatory partial cross-sectional view similar to FIG. 2 (enlarged, but not to proportional scale).

Figure 4:
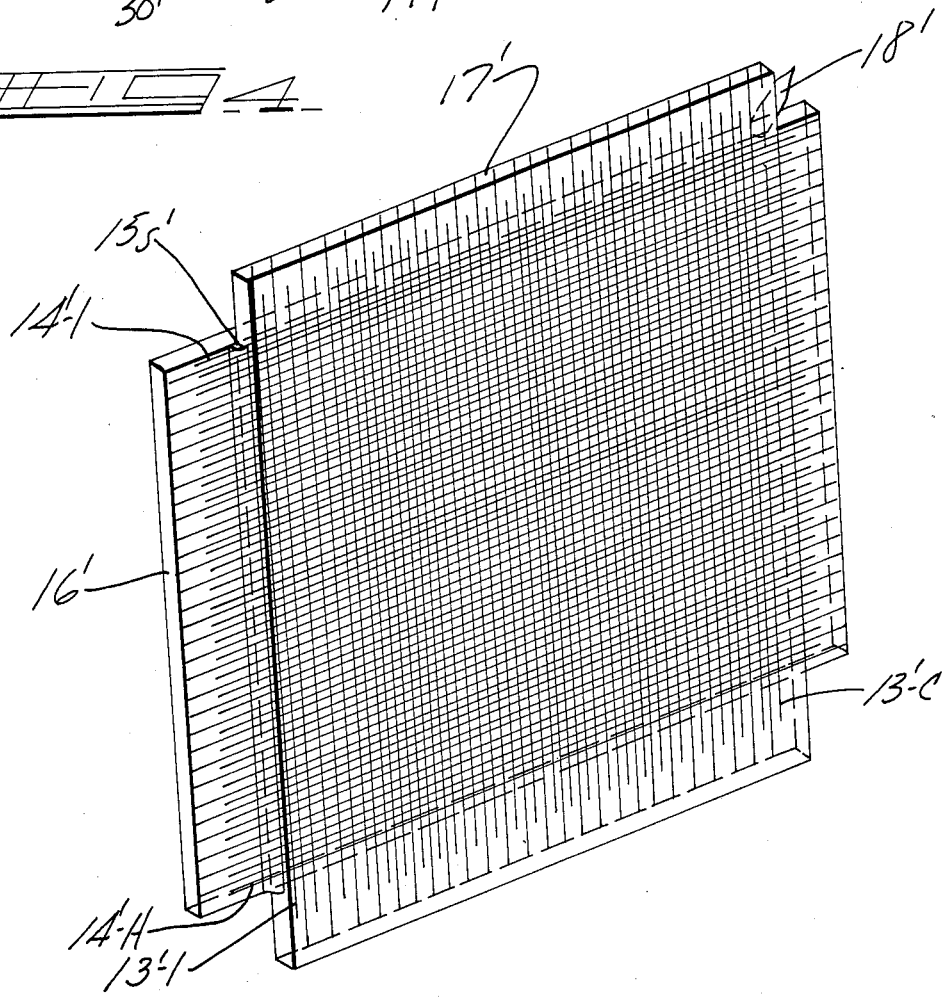

FIG. 4 is an isometric view of a gaseous discharge display/memory panel.

The invention utilizes a pair of dielectric films 10 and 11 separated by a thin layer or volume of a gaseous discharge medium 12, the medium 12 producing a copious supply of charges (ions and electrons) which are alternately collectable on the surfaces of the dielectric members at opposed or facing elemental or discrete areas X and Y defined by the conductor matrix on non-gas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is usually under 10 mils and preferably about 4 to 8 mils, dielectric layers 10 and 11 (over the conductors the elemental or discrete X and Y areas) are usually between 1 and 2 mils thick, and conductors 13 and 14 about 8,000 angstroms thick.

However, support members 16 and 17 are much thicker (partly in larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinary ¼" commercial grade soda lime plate glasses have been used for this purpose. Other glasses such as low expansion glasses or transparent devitrified glasses can be used provided they can withstand processing and have expansion characteristics substantially matching expansion characteristics of the dielectric coatings 10 and 11. For given pressure differentials and thickness of plates, the stress and deflection of plates may be determined by following standard stress and strain formulas (see R. J. Roark, *Formulas for Stress and Strain,* McGraw-Hill, 1954).

Spacer 15 may be made of the same glass material as dielectric films 10 and 11 and may be an integral rib formed on one of the dielectric members and fused to the other members to form bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small beadlike solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 4, the center-to-center spacing of conductors in the respective arrays is about 17 mils. Transparent or semi-transparent conductive material such as tin oxide, gold, or aluminum can be used to form the conductor arrays and should have a resistance less than 3000 ohms per line. Narrow opaque electrodes may alternately be used so that discharge light passes around the edges of the electrodes to the viewer. It is important to select a conductor material that is not attacked during processing by the dielectric material.

It will be appreciated that conductor arrays 13 and 14 may be wires or filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically affected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric/breakdown voltage of about 1000 v. and be electrically homogeneous on a microscopic scale (e.g., no cracks, bubbles, crystals, dirt, surface films, etc.). In addition, the surfaces of dielectric layers 10 and 11 should be good photoemitters of electrons in a baked out condition. Alternatively, dielectric layers 10 and 11 may be overcoated with materials designed to produce good electron emission, as in U.S. Pat. No. 3,634,719, issued to Roger E. Ernsthausen. Of course, for an optical display at least one of dielectric layers 10 and 11 should pass light generated on discharge and be transparent or translucent and, preferably, both layers are optically trans- parent.

The preferred spacing between surfaces of the dielectric films is about 4 to 8 mils with conductor arrays 13 and 14 having center-to-center spacing of about 17 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. In either case, it is to be noted that a lower amplitude of operating potentials helps to reduce problems associated with the interface circuitry between the addressing system and the display/memory panel, per se. Thus, by providing a panel having greater uniformity in the discharge characteristics throughout the panel, tolerances and operating characteristics of the panel with which the interfacing circuitry cooperate, are made less rigid.

One mode of initiating operation of the panel will be described with reference to FIG. 3, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor arrays, said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30' are imaginary lines to show a boundary of one elemental volume about the center of which each elemental discharge takes place. As described earlier herein, it is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

In the instant shown in FIG. 3, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 3. There, the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conductors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 38. Electrons 38 are, in effect, free electrons in gas medium 12 and condition each other discrete elemental gas volume for operation at a lower firing potential $V_f$ which is lower in magnitude than the firing potential $V_f'$ for the initial discharge about the center of elemental volume 30 and this voltage is substantially uniform for each other elemental gas volume.

Thus, elimination of physical obstructions or barriers between discrete elemental volumes, permits photons to travel via the space occupied by the gas medium 12 to impact remote surface areas of dielectric members 10 and 11 and provides a mechanism for supplying free electrons to all elemental gas volumes, thereby conditioning all discrete elemental gas volumes for subsequent discharges, respectively, at a uniform lower applied potential. While in FIG. 3 a single elemental volume 30 is shown, it will be appreciated that an entire row (or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a "fired" condition and producing light in a panel, and in such applications it is not necessary to provide separate discharge or generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by radiating the panel with ultraviolet radiation or by inclusion of a radioactive material within the glass materials or gas space, all discharge volumes can be operated at uniform potentials from addressing and interface circuit 19.

Since each discharge is terminated upon a build up or storage of charges at opposed pairs of elemental areas, the light produced is likewise terminated. In fact, light production lasts for only a small fraction of a half cycle of applied alternating potential and depending on design parameters, is in the nanosecond range.

After the initial firing or discharge of discrete elemental gas volume 30 by a firing potential $V_f'$, switch 33 may be opened so that only the sustaining voltage $V_s$ from source 36 is applied to conductors 13-1 and 14-1. Due to the storage of charges (e.g., the memory) at the opposed elemental areas X and Y, the elemental gas volume 30 will discharge again at or near the peak of negative half cycles of sustaining voltage $V_s$ to again produce a momentary pulse of light. At this time, due to reversal of field direction, electrons 32 will collect on and be stored on elemental surface area Y of dielectric member 11 and positive ions 31 will collect and be stored on elemental surface area X of dielectric member 10. After a few cycles of sustaining voltage $V_s$, the times of discharges become symmetrically located with respect to the wave form of sustaining voltage $V_s$. At remote elemental volumes, as for example, the elemental volumes defined by conductor 14-1 with conductors 13-2 and 13-3, a uniform magnitude or potential $V_x$ from source 60 is selectively added by one or both of switches 34-2 or 34-3 to the sustaining voltage $V_s$, shown as 36', to fire one or both of these elemental discharge volumes. Due to the presence of free electrons produced as a result of the discharge centered about elemental volume 30, each of these remote discrete elemental volumes have been conditioned for operation at uniform firing potential $V_f$.

In order to turn "off" an elemental gas volume (i.e., terminate a sequence of discharge representing the "on" state), the sustaining voltage may be removed. However, since this would also turn "off" other elemental volumes along a row or column, it is preferred that the volumes be selectively turned "off" by application to selected "on" elemental volumes a voltage which can neutralize the charges stored at the pairs of opposed elemental areas.

This can be accomplished in a number of ways, as for example, varying the phase or time position of the potential from source 60 to where that voltage combined with the potential form source 36' falls substantially below the sustaining voltage.

It is apparent that the plates 16–17 need not be flat but may be curved, curvature of facing surfaces of each plate being complementary to each other. While the preferred conductor arrangement is of the crossed grid type as shown herein, it is likewise apparent that where an infinite variety of two dimensional display patterns are not necessary, as where specific standardized visual shapes (e.g., numerals, letters, words, etc.) are to be formed and image resolution is not critical, the conductors may be shaped accordingly.

The device shown in FIG. 4 is a panel having a large number of elemental volumes similar to elemental volume 30 (FIG. 3). In this case more room is provided to make electrical connection to the conductor arrays 13' and 14', respectively, by extending the surfaces of support members 16' and 17' beyond seal 15S', alternate conductors being extended on alternate sides. Conductor arrays 13' and 14' as well as support members 16' and 17' are transparent. The dielectric coatings are not shown in FIG. 4 but are likewise transparent so that the panel may be viewed from either side.

DRAWINGS ILLUSTRATING EXPERIMENTAL DATA

FIGS. 5 to 9, discussed in detail hereinafter, graphically summarize and illustrate the experimental data and results establishing the important advantages of this invention.

Figure 5:
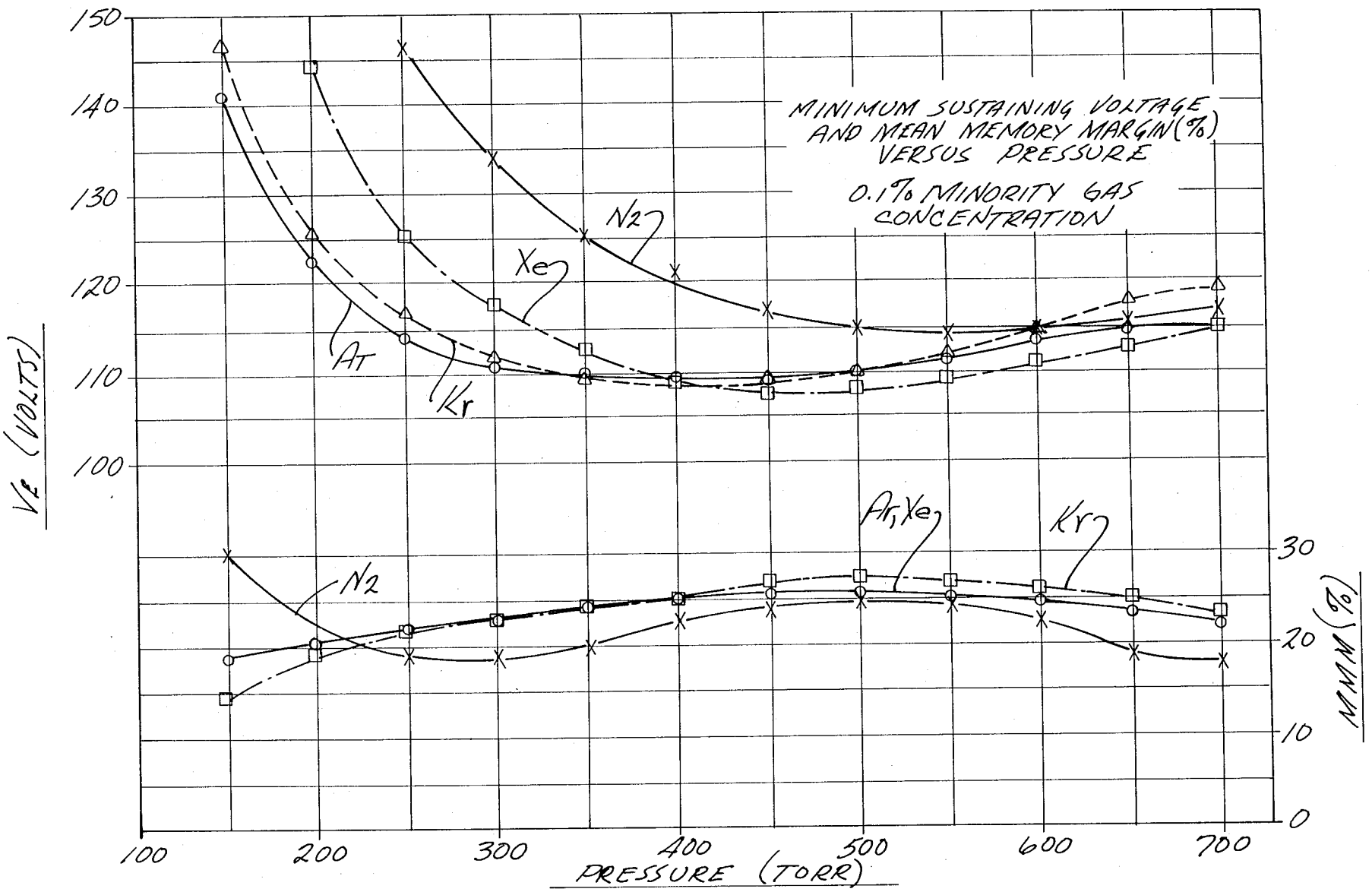
FIGS. 5–10 are graphs.

FIG. 5 is a plot of minimum sustaining voltage $V_E$ versus pressure and percent mean memory margin versus pressure, each curve being for 99.9% atoms of neon and 0.1% atoms of the specified minority rare gas, e.g., argon, krypton, or xenon or 0.1% molecules for nitrogen. Memory margin and sustaining voltage $V_E$ have been defined hereinbefore. In order to obtain percent memory margin, multiply the equation by 100. An atom of rare gas is the same as a molecule of rare gas, so the rare gas and nitrogen were in fact measured on the same scale.

Figure 6:
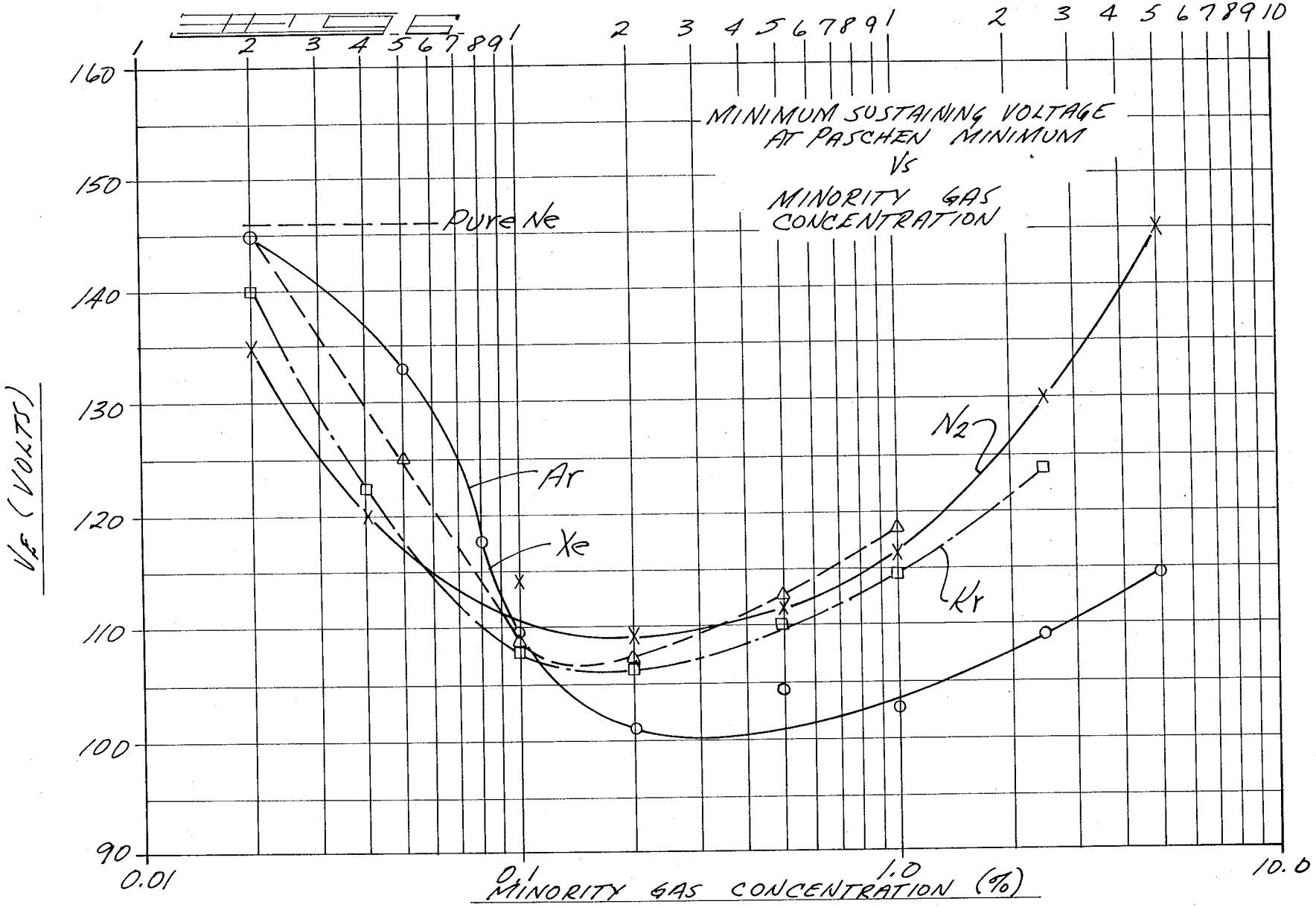

FIG. 6 is a plot of minimum sustaining voltage $V_E$ at the Paschen curve minimum versus minority gas concentration. $V_E$ is as defined earlier. The Paschen minimum is the lowest point on the Paschen curve. A Paschen curve is a plot of voltage (in this case sustaining voltage) versus the product of gas pressure times electrode spacing. In a multiple gas discharge display/memory panel of the Baker, et al. type, the spacing between the opposing dielectric surfaces is used as electrode spacing. A Paschen curve typically reaches a minimum voltage point. $V_E$ was measured for each minority gas concentration at this low point on the Paschen curve. The scale of the minority gas concentration is expressed in percent atoms of minority gas (apercent molecules for nitrogen) over a range of 0.01 to 10 percent atoms (or molecules). The minority gas is selected from nitrogen, argon, krypton, or xenon. The majority gas is neon. The minority gas concentration is plotted on a log scale.

Figure 7:
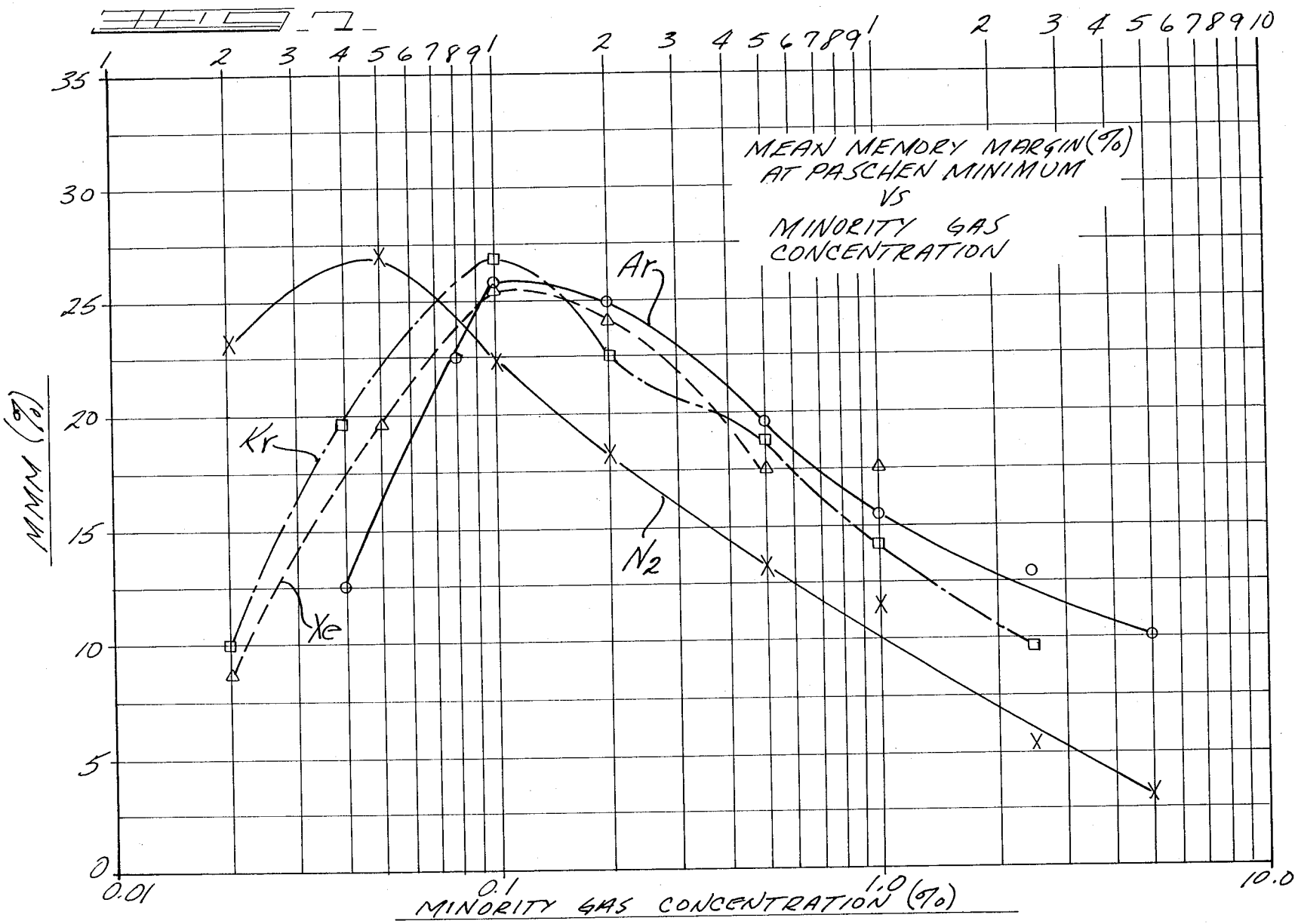

FIG. 7 is a plot of percent mean memory margin at the Paschen curve minimum versus minority gas concentration. This FIG. 7 should be considered in combination with FIG. 6, both having been measured at the same point on the Paschen curve. The terms percent mean memory margin, Paschen minimum, and minority gas concentration are the same as previously defined hereinbefore. The minority gas concentration is plotted on a log scale.

Figure 8:
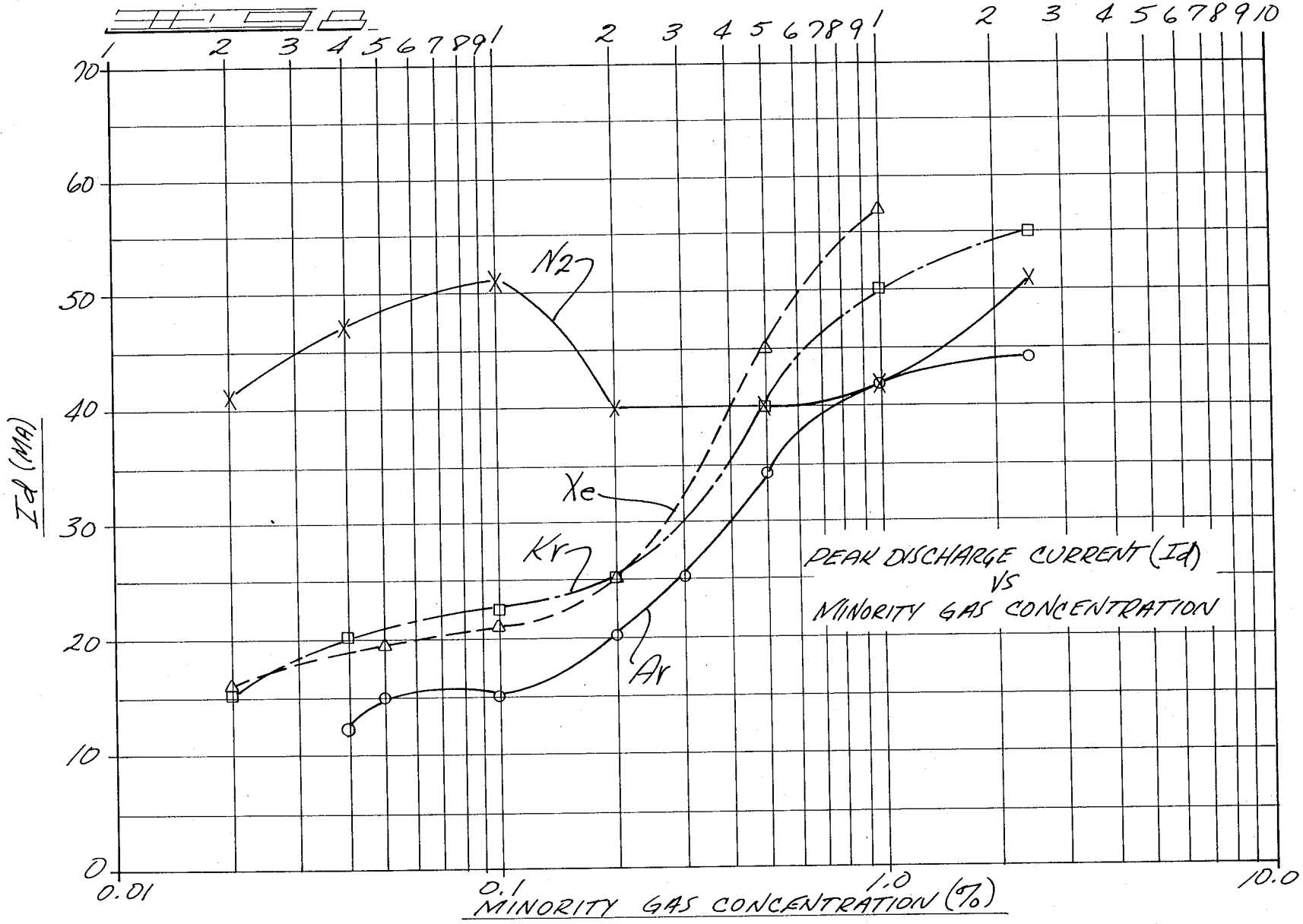

FIG. 8 is a plot of peak discharge current ($I_d$) in milliamperes versus minority gas concentration in percent atoms or molecules. Peak discharge current $I_d$ is defined as the maximum instantaneous value the current reaches across a given portion of the panel while the panel is in the "on" state. In this instance $I_d$ was measured at 2 volts above the Paschen minimum voltage; however, the product of gas pressure and electrode distance remained the same as in the previous FIGS. 6 and 7. Again the minority gas was selected from nitrogen, argon, krypton, or xenon. The majority gas was neon. The minority gas concentration is plotted on a log scale.

Figure 9:
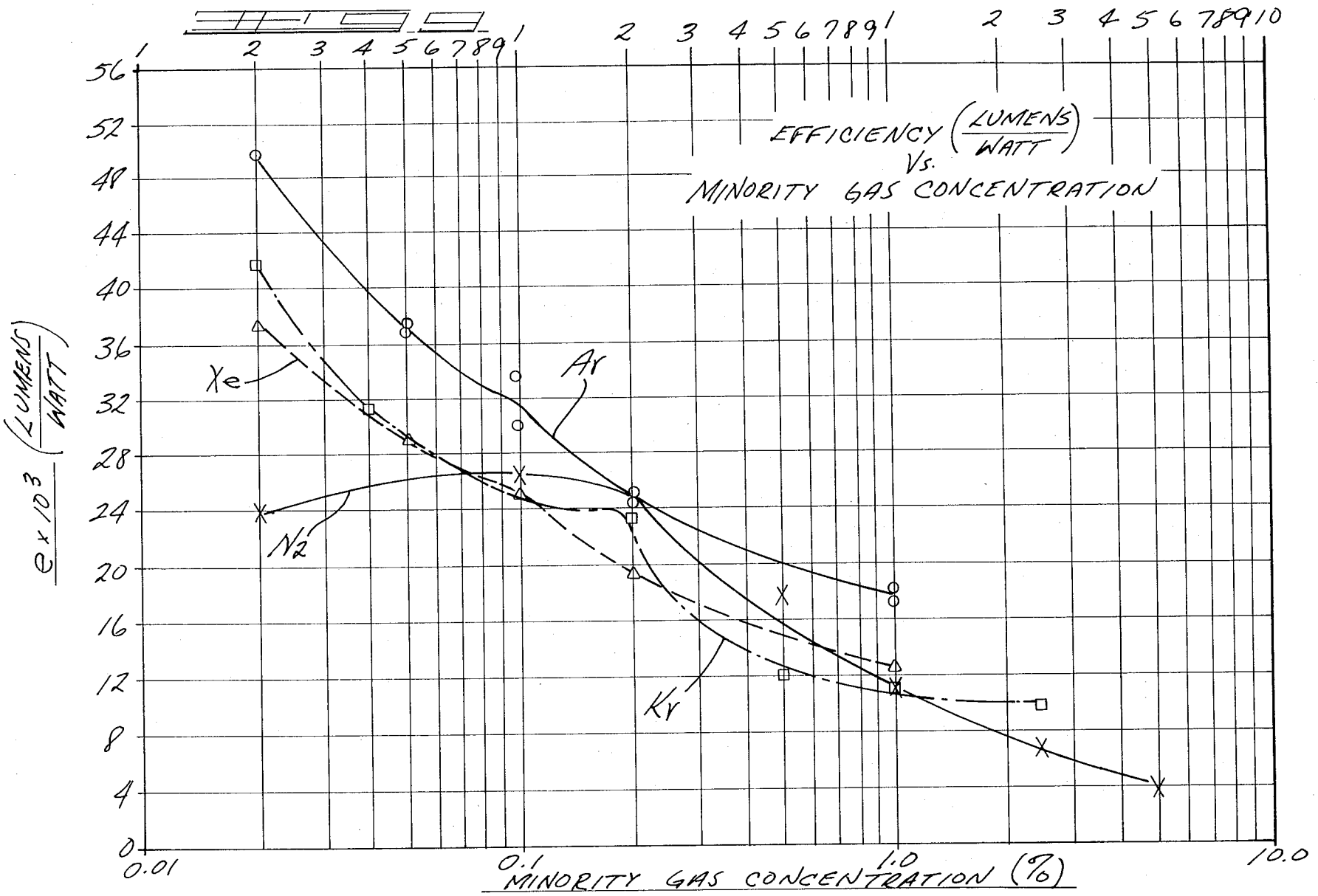

FIG. 9 is a plot of luminous efficiency e versus minority gas concentration. Luminous efficiency is expressed in lumens of visible light output per watt of electrical power input to the panel. It was calculated from measurements taken at 2 volts above the Paschen minimum, the same point at which $I_d$ was measured in FIG. 8. The minority gas concentration is in percent atoms or molecules. Again the minority gas component is selected from nitrogen, argon, krypton, or xenon. The majority gas is neon. The minority gas concentration is plotted on a log scale.

The luminous efficiency plotted in FIG. 9 was obtained by the usual method of measuring the brightness of the light emitted perpendicular to the plane of the display panel and estimating the power from the current pulse shape and the voltage. This standard method, although it is the one normally used to measure luminous efficiency, does not take into account light emitted from the back of the panel, nor does it accurately measure the actual angular distribution of the light emitted. Consequently the data in FIG. 9 may not be accurate in an absolute sense. However, the measurements plotted in FIG. 9 do give a good indication of the relative luminous efficiency versus concentration for the various minority constituents.

DISCUSSION OF RESULTS, CONCLUSIONS AND FIG. 10

The gas compositions of this invention offer many unique advantages when incorporated into a multiple gas discharge display/memory device. Thus in the practice of this invention it has been discovered that the utilization of rare gas mixtures of the specific concentrations defined, herein, results in decreased operating voltages and currents, increased memory margins, and increased luminous efficiency. Other advantages and benefits include chemical inertness to the panel dielectric and other panel physical components.

As noted hereinbefore, the prior art has utilized a variety of gases in many different kinds of gas discharge devices. The present invention is derived from the unobvious discovery of an optimum rare gas mixture to be utilized in a specific gas discharge device; that is, the utilization of the herein defined optimum rare gas composition for the improved operation of a multiple gaseous discharge display/memory device.

In the prior art, a wide variety of gases and gas mixtures have been utilized as the gaseous medium in a number of different gas discharge devices. Typical of such gases include pure gases and mixtures of CO; $CO_2$; halogens; nitrogen; $NH_3$; oxygen; water vapor; hydrogen; hydrocarbons; $P_2O_5$; boron fluoride, acid fumes; $TiCl_4$; Group VIII gases; air; $H_2O_2$; vapors or sodium, mercury, thallium, cadmium, rubidium, and cesium; carbon disulfide, laughing gas; $H_2S$; deoxygenated air; phosphorus vapors; $C_2H_2$; $CH_4$; naphthalene vapor; anthracene; freon, ethyl alcohol; methylene bromide; heavy hydrogen; electron attaching gases; sulfur hexafluoride; tritium; radioactive gases; and the so-called rare or inert gases.

Rare gas mixtures have been utilized in the prior art as a gaseous medium for D.C. discharge devices, e.g., where the electrodes are in direct conductive contact with the gaseous medium. An example of such a device and rare gas composition is disclosed by Morawski, "Experimentalle Untersuchungen uber Zund und Brennspannungen . . . ", Experimentalle Technik der Physik Vol. 10, No. 5 (1962), pp. 355–362.

Reference is also made to FIG. 23, page 114 of an article by Druyvesteyn and Penning, Rev. Mod. Phys. 12, 87 (1940).

The U.S. Patent Office classification system maintains a special sub-classification for the combination of rare gases and gas discharge devices. Reference is made to Class 313, Sub-classes 224 and 226.

Prior to this invention no one had utilized an optimum rare gas mixture, as defined herein, in a multiple gas discharge display/memory panel. Instead the prior art had generally relied upon neon-nitrogen gas mixtures to operate gas discharge display/memory panels. Reference is made to U.S. Pat. No. 3,559,190 issued to Bitzer, et al.

The neon-nitrogen gas mixtures utilized by the prior art offer certain disadvantages in comparison with rare gas concentrations as specifically defined herein. Thus neon-nitrogen gas mixtures tend to have higher peak discharge currents, lower luminous efficiency, lower memory margin, and/or higher operating voltages relative to the specific rare gas concentrations defined herein. Such disadvantages of neon-nitrogen and such advantages of the rare gas mixtures specified herein are not obvious from an examination of the prior art literature, such as Morawski, which typically relates to D.C. or A.C. non-memory type devices.

A specific neon-nitrogen gas mixture may offer a particular advantage over a specific rare gas mixture, but on balance the rare gas mixture will offer a greater number of advantages important in the successful operation of a multiple gaseous discharge display/memory device. For example, as illustrated in FIG. 9, neon-nitrogen tends to give a comparable luminous efficiency over a minority gas concentration range of about 0.1 to 1.0 percent atoms (molecules). However, as illustrated in FIG. 7, the memory margin drastically drops off for neon-nitrogen gas mixtures above, 0.05% molecules of nitrogen. Likewise, as shown in FIG. 8, the peak discharge current for neon-nitrogen gas mixtures tends to be significantly higher than the rare gas mixtures up to a minority gas concentration of 0.4% atoms or molecules.

The results of the experimental data compiled and summarized in FIGS. 5 to 9 particularly illustrate the advantages of utilizing this invention over a preferred minority rare gas concentration range of about 0.05 to 0.2 atoms percent minority gas concentration. In this range, the neon-nitrogen mixtures are especially inferior in comparison with the rare gas compositions of this invention.

The results also illustrate the advantages of utilizing this invention with argon as the minority rare gas component.

In evaluating gas mixtures for use in display/memory panels a number of different parameters must be considered. As illustrated hereinbefore, some of the most important are operating voltage, peak current, memory margin, and luminous efficiency. Although some mixtures may be better than others in a particular range with respect to one of the desired properties, one is primarily interested in the best overall combination of the desirable properties.

In evaluating various gas mixtures it is useful to define a Figure of Merit which is a measure of how well a particular gas mixtures meets the combination of desired properties. The Figure of Merit is defined as follows:

$$F.M. = \frac{M.M.M. \times e}{I \times V}$$

where MMM is the % mean memory margin, e is the luminous efficiency, I is the peak current, and V is the minimum sustaining voltage. The memory margin and luminous efficiency are in the numerator since it is desired that they be as large as possible. The peak current and voltage are in the denominator since it is desired that they be as small as possible; that is, a smaller peak current or voltage would produce a larger Figure of Merit. Thus, the larger the Figure of Merit, the better the gas mixture in question fulfills the combination of the four properties. It would be possible to define a Figure of Merit differently, but the definition used is the simplest one involving these four properties.

Figure 10:
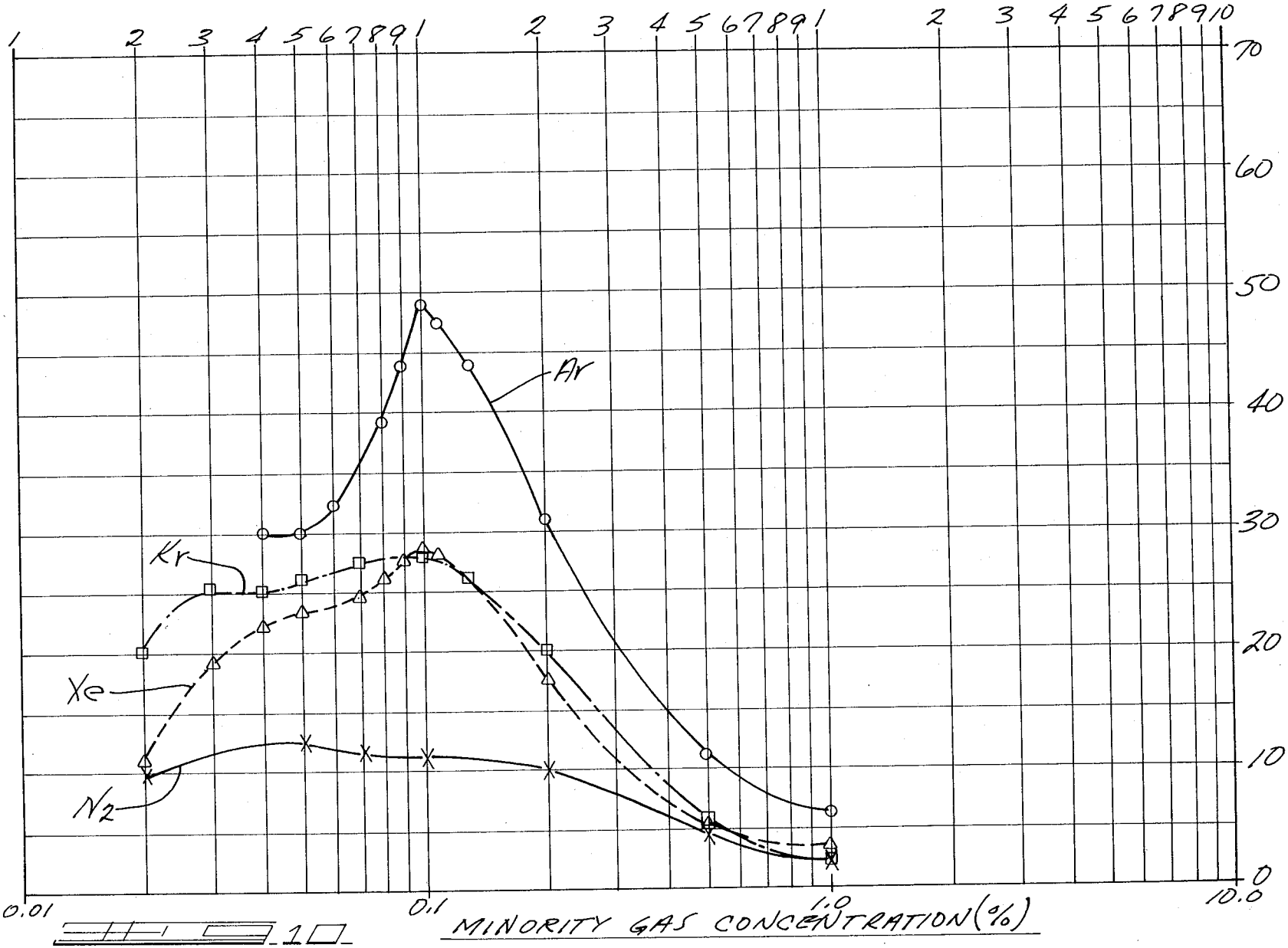

FIG. 10 shows the Figure of Merit for gas mixtures with argon, krypton, xenon, and nitrogen as the minority constituent. The data for FIG. 10 was taken from FIGS. 6, 7, 8, and 9.

The results of the Figure of Merit calculated and plotted in FIG. 10 confirms the already discussed advantages of this invention.

EXAMPLE

The data summarized in FIGS. 5 to 10 compares the rare gases and nitrogen over a minority gas concentration which extends to less than 1 percent atoms (or molecules). However, before the discovery of this invention, it was the practice to use mixtures of neon and over 3 percent molecules of nitrogen; typically as high as 10 percent. Reference is made to U.S. Pat. No. 3,559,190 issued to Bitzer, et al.

Accordingly, experiments were conducted to compare the relative brightness output per unit of power consumption for a gaseous mixture of 99.9% atoms of neon—0.1% atoms of argon versus a gaseous mixture of 97% atoms of neon—3% molecules of nitrogen. The comparison was conducted at two different frequencies, 50 KHZ and 20 KHZ. The results are tabulated in TABLES I and II.

TABLE I

| Neon plus .1% atoms of Argon | | |
|---|---|---|
| Frequency, KHZ | 50 | 20 |
| Power Consumption, watts per sq. inch | .71 | .175 |
| Brightness, foot-lamberts | 15.3 | 2.87 |
| Brightness per unit power consumption | 15.3/.71 = 21.6 | 2.87/.175 = 16.4 |

TABLE II

| Neon plus 3% molecules of Nitrogen | | |
|---|---|---|
| Frequency, KHZ | 50 | 20 |
| Power Consumption, watts per sq. inch | 4.1 | 1.86 |
| Brightness, foot-lamberts | 8 | 2.72 |
| Brightness per unit power consumption | 8/4.1 = 1.95 | 2.72/1.86 = 1.46 |

On the basis of the results illustrated in TABLES I and II, it is seen that the brightness per unit power consumption is outstandingly greater for the neon-argon mixture of TABLE I versus the neon-nitrogen mixture of TABLE II.

OTHER FEATURES

In the operation of the panel, the purity of the gas mixture is essential in order to maintain uniform operating characteristics, especially lower operating voltages and frequency requirements. Thus, in another important embodiment of this invention, the gaseous mixture is purified before and/or after being introduced into the panel by appropriate contact with a getter material; that is, the gaseous mixture is purified by gettering.

It is contemplated that any suitable getter material may be used including misch metal (consisting principally of cerium, lanthanum, and iron), zirconium, tantalum, aluminum, magnesium, thorium, uranium, and alkaline earth metal such as barium, strontium, and calcium.

The exact getter to be used is a function of the impurities to be removed. Typically, getters are used for adsorption of undesired gaseous impurities as illustrated in TABLE III.

TABLE III

| Getter | Gases adsorbed |
|---|---|
| aluminum | $O_2$, $N_2$, $H_2$, $CO_2$ |
| barium | $O_2$, $N_2$, $H_2$, $CO_2$ |
| magnesium | $O_2$, $N_2$, $H_2$, $CO_2$ |
| thorium | $O_2$, $H_2$ |
| uranium | $O_2$, $H_2$ |
| misch metal | $O_2$, $N_2$, $H_2$, $CO_2$ |
| zirconium | $O_2$, $N_2$, $H_2$, $CO_2$ |

In the practice of this invention the use of getters is especially beneficial since getters typically are effective on oxygen, nitrogen, hydrogen, carbon dioxide, and water vapor but do not absorb the inert gases—neon, argon, krypton, and xenon.

Small amounts of undesirable gases released or formed during tip-off, burn-in, and from other causes, while not adversely affecting conventional neon discharge devices where operating parameters are not critical, can adversely affect the operating characteristics of multiple gas discharge devices having an internal memory wherein discharge conductors are dielectrically isolated (insulated) from the gas and the discharge medium is a thin volume of gas at a relatively high gas pressure. Such contaminants can affect the operating voltages, memory characteristics, etc. and, in general are undesirable. Accordingly, in addition to providing novel gas discharge panels and gas compositions therefor, this invention also comprises the use of a getter for gas purification so as to obtain superior panel performance.

It is contemplated that the gaseous mixture used in the panel may be purified by means of any suitable gettering system. In one specific embodiment hereof, a getter (such as barium) is placed in an auxiliary glass envelope and attached by an appendage tube to the fabricated gaseous discharge panel. After baking out of the panel under vacuum at a temperature not sufficient to vaporize the getter, the inert gas mixture is introduced into the panel. The getter is then activated (flashed) by heating to about 900° to 1100° C., e.g., by RF induction. Such getter activation may be prior to the introduction of the inert gas mixture to the panel. After a period of time sufficient for complete diffusion (statistically) of the gas throughout the panel and the auxiliary glass envelope, the entire gas mixture is purified by contact with the flashed getter. The getter may then be removed or else left as part of the panel system.

For the operation of a multiple gas discharge display/memory panel, a variety of hardware and circuitry is available in the prior art. Reference is made to U.S. Pat. No. 3,513,327 issued to Johnson; U.S. Pat. No. 3,618,071 issued to Johnson, et al.; U.S. Pat. No. 3,754,150 issued to Leuck; and others well known in the art.

In one preferred practice hereof, the multiple gas discharge display/memory panel is addressed and operated by means of square wave signals and impulses.

Since panels constructed with gaseous discharge mediums as described in the specific embodiment of this invention have lower operating voltages and current requirements, presently available semi-conductor components may be used in supplying operating potentials to the conductor arrays. Moreover, such relatively lower voltage and current requirements permit the use of integrated circuitry in designing operating voltage supplies. At the same time the power consumption for a given light output level is reduced with an attendant reduction in operating temperature and possible reductions in stress due to temperature differentials. This beneficial result has a corollary result in further rendering operating voltages for individual discharge units more uniform since there is less warping and deflection of panels due to temperature, thus maintaining uniform spacing, e.g., discharge gaps.

Additional beneficial results can also be obtained since the effects of discharge gap variation between discharge units in a given panel are minimized and the operating voltages rendered more uniform, such that lower memory margins may be used.

PREPARATION OF DISCHARGE PANEL

A discharge panel having the structure shown in FIG. 1 to 4 was prepared.

PREPARATION OF SUBSTRATE MEMBERS 16 AND 17

The substrate glass members 16 and 17 were prepared by cutting 6½ inches×5 inches×¼ inch plates from 24 inches×24 inches×¼ inch twin ground flat glass panes after normal quality inspection. An analysis of the panes with physical properties is given in TABLE IV

TABLE IV

| Component | Percent By Weight |
|---|---|
| $SiO_2$ | 72.78 |
| $Al_2O_3$ | 1.17 |
| $Fe_2O_3$ | .148 |
| $Na_2O$ | 13.15 |
| $K_2O$ | 0.12 |
| CaO | 9.33 |
| MgO | 2.99 |
| BaO | Nil |
| $As_2O_3$ | $0.05_1$ |

TABLE IV-continued

| Component | Percent By Weight |
|---|---|
| $SO_3$ | 0.24 |
| $Cr_2O_3$ | 0.0008 |
| | 99.97 |

The cut edges were beveled on a belt grinder using wet 80 grit silicon carbide cloth, followed by water wash and hand drying. The edges were then acid fortified by brushing an HF acid paste on the ground areas, etching for 10–15 seconds, and then washing in alconox and water. The chemical composition of the acid paste was 70 milliliters of 52% by weight hydrofluoric acid, 20 milliliters of concentrated sulfuric acid, 5 milliliters of aerosol O.T., 20–25 milliliters of Dextraglucose (Karo white), and 18.8 grams of wood flour. The resulting dimensions of the beveled, HF acid fortified members were 6 inches×5 inches×¼ inch.

The members were then scanned for out-of-flat using a Federal Precision Height Gauge (standard model 2400). Thickness measurements were taken on both plates at nine points on each member using a Pratt and Whitney Supermicrometer Model "B". The flatness and thickness measurement results are summarized in TABLE IIA. The physical properties of the substrates are summarized in TABLE IIB.

TABLE IIA

| Substrate 17 | | Substrate 16 | |
|---|---|---|---|
| FLATNESS (To 3 Point Zero Reference Plane) | | | |
| Max.+ = | .45 mils | Max.+ = | 1.05 mils |
| Min.− = | 0 mils | Min.− = | 0 mils |
| Range = | .45 mils | Range = | 1.05 mils |
| THICKNESS | | | |
| Max. = | .23396" | Max. = | .23573" |
| Min. = | .23386" | Min. = | .23564" |
| Range = | .00010" | Range = | .00009" |

TABLE IIB

| | |
|---|---|
| Softening Point | 727° C. |
| Annealing Point | 548° C. |
| Strain Point | 505° C. |
| Coef. of Expansion | 89 ($10^{-7}$) (0–300° C.) |
| Coef. of Contraction | 106 ($10^{-7}$) (A.P. -25° C.) |
| Coef. of Contraction | 94 ($10^{-7}$) (435° C.-25° C.) |
| Transmittance | 86–88% |
| Stress Optical Coef. | 2.63 mμ/cm/kg/cm$^2$ |

Both substrate members were then ultrasonically cleaned in alconox, water, and alcohol.

APPLICATION OF CONDUCTOR ARRAYS (ELECTRODES) 13 AND 14

Hanovia gold (milled to a −400 mesh and containing a lead borate flux) conductor arrays (electrode lines) were printed on each glass substrate using a screen printing process. The printed electrode lines were air dried for several minutes and the substrates were then fired on ½ inch lava bases in an electric recirculating oven under the firing cycle conditions summarized in TABLE V.

TABLE V

| ELECTRODE FIRING CONDITIONS | |
|---|---|
| Heating rate | 5° F./min. |
| Binder Burnout Plateau | 650° F./15 min. |
| Peak Temperature | 1150° F./55 min. |

TABLE V-continued

| ELECTRODE FIRING CONDITIONS | |
|---|---|
| and Time | |
| Cooling Rate | 1.95° F./min. |

After the firing cycle, one end of each electrode was shorted using an air dry, acetone soluble, conductive silver paste containing butyl acetate thinner. Line continuity and resistance measurements were than taken an ohmmeter scanning device. The results are summarized in TABLE VI.

TABLE VI

| LINE CONTINUITY AND RESISTANCE OF ELECTRODES AFTER FIRING | | | |
|---|---|---|---|
| Panel No. 17 | | Panel No. 16 | |
| Line Width | 8.0 mils | Line Width | 7.0 mils |
| Line thickness | .3-.5 mils | Line thickness | .3-.5 mils |
| Not measured Usually | | Not measured Usually | |
| No lines Broken | 4 | No Lines Broken | 3 |
| Plate Total Out-Of-Flat Scan | .50 mils | Plate Total Out-Of-Flat Scan | .55 mils |
| Line Resistance | 4 ohms | Line Resistance | 3 ohms |

APPLICATION OF DIELECTRIC MEMBERS 10 AND 11

After the electrode processing operation the substrates were cleaned by hand in Safety Solvent Solution, wiped dry with Kayday towels, and blown off with filtered air.

Dielectric members 10 and 11 were then formed by applying to each substrate a $4\frac{3}{4}$ inches of 5-3/16 inches by $1\frac{1}{2}$ mil thick layer of lead borosilicate dielectric material consisting of 73.3% by weight PbO, 13.4% by weight $B_2O_3$, and 13.3% by weight $SiO_2$.

Four glass rod spacers having a diameter of 8 mils and a length of 3 inches were placed on approximate centers of $1\frac{1}{4}$ inch in the set dielectric material on substrate 16.

The dielectric material on the substrates was air dried for 10 to 15 minutes and then heat cured by firing the substrates on $\frac{1}{2}$ inch lava plates in an electric oven under the conditions summarized in TABLE VII.

TABLE VII

DIELECTRIC HEAT CURING CONDITIONS

TABLE VII

| DIELECTRIC HEAT CURING CONDITIONS | |
|---|---|
| Heating Rate | 4° F./min. |
| Curing Peak Temp. and Time | 1150° F./30 min. |
| Cooling Rate | 1.37° F./min. |

An air oxygen purge was used during the heat up and curing temperatures, the purge consisting of a ratio of 15% $O_2$ to 85% air introduced at the rate of 18 liters per minute (by volumes uncorrected to standard conditions). After the dielectric curing cycle the electrical continuity and resistance of the electrodes were again measured. The results of the measurements are summarized in TABLE VIII.

TABLE VIII

| | Plate No. 17 | | Plate No. 16 | |
|---|---|---|---|---|
| Diel. Thickness | Max. = | 2.90 mils | Max. = | 2.26 mils |
| | Min. = | 2.62 mils | Min. = | 2.03 mils |
| | Range = | .28 mils | Range = | .23 mils |
| | Average = | 2.73 mils | Average = | 2.14 mils |
| Out-Of-Flat (Diel.) | Max. = | −.34 mils | Max. = | −.56 mils |
| | Min. = | −.06 mils | Min. = | 0 mils |
| | Range = | .28 mils | Range = | .56 mils |
| Line Resistance | | 4 ohms | | 3 ohms |
| Lines Broken | | 4 | | 3 |

The physical properties of the dielectric material are summarized in TABLE IX.

TABLE IX

| DIELECTRIC PHYSICAL PROPERTIES | |
|---|---|
| Softening Point | 452° C. (Glassy Edge) |
| Annealing Point | 400° C. |
| Strain Point | 380° C. |
| Coef. of Expansion | 83 (0-300° C.) ($10^{-7}$) |
| Coef. of Contraction | 105 (A.P. to RT) ($10^{-7}$) |
| Dielectric Constant | 16.1 |
| Dissipation Factor | .0028 |
| Loss Factor | .0451 |
| Power Factor Δ % | .28 |

The chemical composition of the four glass rod spacers is summarized in TABLE X and the physical and electrical properties thereof are summarized in TABLE XI.

TABLE X

| GLASS SPACING ROD(S) COMPOSITION | |
|---|---|
| Component | Percent by Weight |
| $SiO_2$ | 56.3% |
| $Al_2O_3$ | 1.9% |
| $K_2O$ | 8.9% |
| $Na_2O$ | 3.5% |
| CaO | >0.1% |
| MgO | >0.3% |
| $As_2O_3$ | 0.3% |
| PbO | 29.1% |

TABLE XI

| PHYSICAL AND ELECTRICAL PROPERTIES OF GLASS SPACING ROD(S) | |
|---|---|
| Softening Point | 632° C. |
| Annealing Point | 436° C. |
| Strain Point | 395° C. |
| Coef. of Expansion | 90 (0-300° C.) × ($10^{-7}$) |
| Coef. of Contraction | 103 (A.P.-25° C.) × ($10^{-7}$) |
| Density | 3.05 |
| Durability | 4.7 (Loss mg. per $cm^2$) (1/5 N $H_2SO_4$) |
| Electrical | |
| Log Resistivity 250° C. | 9.9 |
| Log Resistivity 350° C. | 7.8 |

ASSEMBLY AND SEALING

After the dielectric application the substrates were cleaned and dried. A 3/16 inch wide border of sealing solder glass in a 15S was applied to a thickness of 11-12 mils each substrate. The solder glass vehicle was 50% by weight poly alpha methyl styrene and 50% by weight DuPont Silver Thinner No. 8250. After application the solder glass was cured into the glassy state by firing to 600°-650° F. for 20 minutes with 9° F./minute heating and cooling rates. In this state the thickness was reduced to 6–7 mils.

The composition of the solder glass is given in TABLE XII. The physical and electrical properties thereof are given in TABLE XIII.

TABLE XII

| CHEMICAL COMPOSITION OF SOLDER GLASS | |
|---|---|
| Component | Percent by Weight |
| $SiO_2$ | 5.37% |
| $Al_2O_3$ | 1.17% |
| $B_2O_3$ | 7.78% |
| PbO | 71.00% |
| ZnO | 12.32% |
| BaO | 1.82% |
| $Na_2O$ | .15% |
| $K_2O$ | .06% |
| $Li_2O$ | .22% |

TABLE XIII

| PHYSICAL AND ELECTRICAL PROPERTIES OF SOLDER GLASS | |
|---|---|
| Physical Properties | |
| Coef. of Expansion | 87 ($10^{-7}$/°C.) |
| Coef. of Contraction | 95 ($10^{-7}$/°C.) |
| Density gms/cc | 6.05 |
| Durability | $H_2O$ - 1.98 |
| (Loss mg. per sq. cm.) | HCL - 7.66 (1/50 N) |
| | 30 min. 21° C. |
| Gradient Boat Tests | |
| Glassy Edge | 375° C. |
| Crystallization Edge | 410° C. |
| Glassy Range | 35° C. |
| Button Flow | .970" |
| Electrical | |
| Dielectric Constant | 21.5 |
| Dielectric Strength | 1090 |
| Power Factor Δ % | .94 |
| Log Resistivity 250° C. | 8.5 (P) ohm - cm |
| Log Resistivity 350° C. | 6.9 |

A ¼" hole was drilled in plate 16 at one corner using a water cooled diamond core drill. The drilled hole was then acid fortified by the same procedure used in the edge fortification. The hole was then cleaned by hand in hot water followed by an alcohol rinse.

The substrate plates 16 and 17 were then assembled by matching the glazed solder glass borders, placing them on sealing racks, and weighting the top plate 16 with 1¾ pounds of small Lava blocks.

A ¼ inch tubulation 18 was then placed in the drilled hole of top plate 16 and solder glass (TABLES X and XI), with amyl acetate - nitro cellulose vehicle, applied to the periphery.

The dimensions, chemical composition, and physical properties of the tubulation 18 are given in TABLE XIV.

TABLE XIV

| PROPERTIES OF TUBULATION 18 | |
|---|---|
| Dimensions | |
| ¼" Tubing | |
| O.D. Max. | .255" |
| O.D. Min. | .240" |
| Wall Thickness | .050"(+.010") |
| Chemical Composition | |
| $SiO_2$ | 70.6% by weight |
| $B_2O_3$ | 0.2% |
| $Al_2O_3$ | 2.0% |
| $K_2O$ | 0.3% |
| $Na_2O$ | 12.4% |
| CaO | 7.2% |
| MgO | 5.3% |

TABLE XIV-continued

| PROPERTIES OF TUBULATION 18 | |
|---|---|
| $As_2O_3$ | 0.02% |
| BaO | 1.0% |
| $Fe_2O_3$ | 0.07% |
| $SO_3$ | 0.2% |
| Physical Properties | |
| Softening Point | 735° C. |
| Annealing Point | 547° C. |
| Strain Point | 504° C. |
| Coef. of Expansion | 83 (0–300° C.)($10^{-7}$) |
| Coef. of Contraction | 102 (A.P.–25° C.)($10^{-7}$) |
| Density | 2.52 gm/cc |
| Durability | 6.5 (Loss mg. per $cm^2$) ($H_2SO_4$) (1/50 N) |

The plates 16 and 17 and the tubulation 18 were then sealed by heating at 425° C. for one hour. The heating and cooling rate was 2° per minute.

After sealing the panel was tested for leakage using a Vacuum Instrument Corp. leak detector. Finally, nine point thickness measurement were taken and final spacing calculated. The results are given in TABLE XV.

TABLE XV

| FINAL AVERAGE DIMENSIONS OF SEALED PANEL BEFORE BAKE-OUT BASED ON NINE POINTS MEASUREMENTS | |
|---|---|
| Top Substrate 16 | |
| Ave. Initial Thickness | .23390 mils |
| Range (Max. Thickness Minus Min. Thickness) | .00011 mils |
| Ave. Thickness with Dielectric | .23663 mils |
| Range (Max. minus Min.) | .00031 mils |
| Calc. Ave. Dielectric Thickness | 2.73 mils |
| Range (Max. Minus Min.) | .28 mils |
| Bottom Substrate 17 | |
| Ave. Initial Thickness | .23568 mils |
| Range (Max. Thickness Minus Min. Thickness) | .00009 mils |
| Ave. Thickness with Dielectric | .23784 mils |
| Range (Max. minus Min.) | .00018 mils |
| Calc. Ave. Dielectric Thickness | 2.14 mils |
| Range (Max. minus Min.) | .23 mils |
| Spacing Between Dielectric Members | |
| Ave. Spacing | 4.70 mils |
| Range (Max. Minus Min.) | .56 mils |

PANEL BAKEOUT AND GAS FILLING

The panel was flamed sealed to a bakeable 4-inch Veeco High Vacuum system and a spark coil used to check for large leaks. The device was rough pumped to 10 microns of Hg and then high vacuum pumped down to $10^{-7}$ Torr. The panel was then subjected to a bake cycle consisting of a heating rate of 1.08° C. per minute, baking at 400° C. for 8 hours, and a cooling rate of 0.34° C. per minute down to a baking oven temperature of 93° C.

The panel was then filled with a gas mixture consisting of 99.9% of neon and 0.1% atoms of argon to an absolute pressure of 24.62 inches of Hg. The tubulation 18 was then tipped off and flamed sealed with a torch.

STATIC AND DYNAMIC TESTING OF PANEL ELECTRICAL CHARACTERISTICS

After the panel was baked out and gas filled, it was tested for static and dynamic characteristics. In the static test, nine matrices were selected from different areas of the panel, and the magnitude of the sine wave voltage required to turn on all the units in these matrices was measured at a frequency of 50 $KH_z$. Also, the magnitude of the minimum sine wave voltage which would maintain all the units in the "on" state was measured. It was found that in the voltage range from 335 to 350 Volts peak to peak all of the units in all the tested matrices were maintained in the "on" state after having been turned on at a higher voltage; none of the units in any of the tested matrices were turned on by the sine wave signal in the above mentioned sustaining voltage range. Thus, a typical operating, or sustaining, voltage for the panel would be in the range from 335 to 350 Volts peak to peak.

In the dynamic test, a sine wave sustaining voltage within the operating range was applied to nine selected matrices. These nine matrices were similar to, but not precisely identical to, the nine matrices used in the static test. A 2 microsecond pulse, superimposed on the sine wave, was applied sequentially to units within the test matrices to determine how many of the units could be turned on and off with the same sustaining voltage applied to all units of the matrices. It was found that in all cases the percentage of units which could be turned on and off exceeded 95%, and typically exceeded 99%, thereby demonstrating that the voltage characteristics of the units were substantially uniform.

I claim:

1. A glow discharge device comprising: an envelope, electrodes, lead-in wires connected to the electrodes, said lead-in wires extending through and hermetically sealed in said envelope, said envelope containing a Penning mixture fill gas of neon and xenon wherein said xenon may vary between 0.001 percent to 1.0 percent by volume.

2. A glow discharge device as claimed in claim 1 wherein said xenon may vary between 0.001 percent to 0.1 percent by volume.

3. A glow discharge device as claimed in claim 1 wherein said xenon may vary between 0.01% to 0.1 percent by volume.

4. A glow discharge device as claimed in claim 1 wherein said xenon equals 0.1 percent by volume.

5. A glow discharge device as claimed in claim 1 wherein said xenon equals 0.01 percent by volume.

* * * * *